US011674251B2

(12) United States Patent
Kim et al.

(10) Patent No.: US 11,674,251 B2
(45) Date of Patent: Jun. 13, 2023

(54) CONTROL METHOD OF LAUNDRY TREATING APPARATUS

(71) Applicant: LG Electronics Inc., Seoul (KR)

(72) Inventors: Seungjoon Kim, Seoul (KR); Sungmin Kim, Seoul (KR); Jongryong Kim, Seoul (KR); Seungchul Park, Seoul (KR)

(73) Assignee: LG Electronics Inc., Seoul (KR)

( * ) Notice: Subject to any disclaimer, the term of this patent is extended or adjusted under 35 U.S.C. 154(b) by 395 days.

(21) Appl. No.: 16/902,434

(22) Filed: Jun. 16, 2020

(65) Prior Publication Data

US 2021/0002805 A1 Jan. 7, 2021

(30) Foreign Application Priority Data

Jul. 2, 2019 (KR) ..... 10-2019-0079337

(51) Int. Cl.

| | |
|---|---|
| ***D06F 33/48*** | (2020.01) |
| ***D06F 33/40*** | (2020.01) |
| ***D06F 34/16*** | (2020.01) |
| ***D06F 37/22*** | (2006.01) |
| *D06F 105/48* | (2020.01) |

(Continued)

(52) U.S. Cl.

CPC ..... *D06F 33/48* (2020.02); *D06F 33/40* (2020.02); *D06F 34/16* (2020.02); *D06F 37/225* (2013.01); *D06F 2103/24* (2020.02); *D06F 2103/26* (2020.02); *D06F 2105/48* (2020.02)

(58) Field of Classification Search

CPC ..... D06F 33/40; D06F 33/48; D06F 33/76; D06F 34/16; D06F 34/18; D06F 35/007; D06F 37/225; D06F 2103/04; D06F 2103/24; D06F 2103/26; D06F 2105/46; D06F 2105/48; D06F 2105/62

See application file for complete search history.

(56) References Cited

U.S. PATENT DOCUMENTS

2007/0039104 A1* 2/2007 Lee ..... D06F 34/16 68/23.1

2018/0044836 A1 2/2018 Seo et al.

FOREIGN PATENT DOCUMENTS

EP 2103726 9/2009

OTHER PUBLICATIONS

Extended European Search Report in European Application No. 20180235.2, dated Nov. 2, 2020, 8 pages.

* cited by examiner

*Primary Examiner* — David G Cormier

(74) *Attorney, Agent, or Firm* — Fish & Richardson P.C.

(57) ABSTRACT

A control method of a laundry treating apparatus includes rotating a drum at a reference rotational speed that is lower or higher than a resonance rotational speed of the laundry treating apparatus; measuring the maximum displacements of tub front and rear surfaces and a phase difference between the maximum displacements during the rotation of the drum at the reference rotational speed; determining a front unbalance (UB) mass located in a drum front area, a rear UB mass located in a drum rear area, and an angle between the UB masses based on the maximum displacements and the phase difference; and accelerating a drum rotational speed to a target rotational speed that is higher than the reference rotational speed and the resonance rotational speed, when the front and rear UB masses are in a preset allowable mass range and an angle between the UB masses is in an allowable angle range.

20 Claims, 8 Drawing Sheets

(51) Int. Cl.

| | |
|---|---|
| *D06F 103/26* | (2020.01) |
| *D06F 103/24* | (2020.01) |

FIG. 4

Interaction generated by the rear UB mass

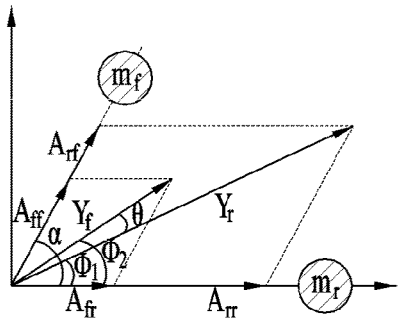

$$\frac{\sin(\pi-\alpha)}{Y_r}=\frac{\sin\Phi_1}{A_{rf}}=\frac{\sin\Phi_1}{bm_f},$$

$$\frac{\sin(\pi-\alpha)}{Y_f}=\frac{\sin\Phi_2}{A_{ff}}=\frac{\sin\Phi_2}{am_f}$$

$$\rightarrow \frac{Y_r\sin\Phi_1}{bm_f}=\frac{Y_f\sin\Phi_2}{am_f}=\frac{Y_f\sin(\theta+\Phi_1)}{am_f} \quad \text{---(e1)}$$

$$\rightarrow \Phi_1=\tan^{-1}\left(\frac{Y_f b\sin\theta}{Y_r a-Y_f b\cos\theta}\right) \quad \text{---(e2)}$$

Interaction generate by the front UB mass

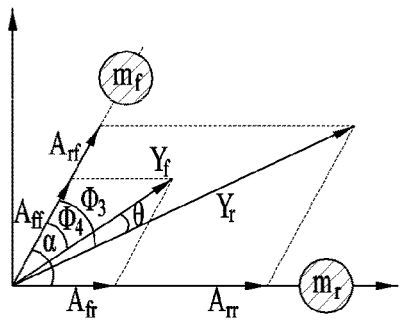

$$\frac{\sin(\pi-\alpha)}{Y_r}=\frac{\sin\Phi_3}{A_{rr}}=\frac{\sin\Phi_3}{dm_r},$$

$$\frac{\sin(\pi-\alpha)}{Y_f}=\frac{\sin\Phi_4}{A_{fr}}=\frac{\sin\Phi_4}{cm_r}$$

$$\rightarrow \frac{Y_r\sin\Phi_3}{dm_r}=\frac{Y_f\sin\Phi_4}{cm_r}=\frac{Y_f\sin(\Phi_3-\theta)}{cm_r} \quad \text{---(e3)}$$

$$\rightarrow \Phi_3=\tan^{-1}\left(\frac{Y_r d\sin\theta}{Y_f d\cos\theta-Y_r c}\right) \quad \text{---(e4)}$$

$$\alpha=\Phi_1+\Phi_3 \quad \text{---(e5)}$$

$$m_f=\frac{Y_r\sin\Phi_1}{b\sin(\pi-\alpha)},\ m_r=\frac{Y_r\sin\Phi_3}{d\sin(\pi-\alpha)} \quad \text{---(e6)}$$

$$A_{ff} \propto m_f \Rightarrow A_{ff} = a \cdot m_f$$

$$A_{rf} \propto m_f \Rightarrow A_{rf} = b \cdot m_f$$

$$A_{fr} \propto m_r \Rightarrow A_{fr} = c \cdot m_r$$

$$A_{rr} \propto m_r \Rightarrow A_{rr} = d \cdot m_r$$

| Allowable mass range | Allowable angle range |
|---|---|
| First allowable mass range | 0~180 degrees |
| Second allowable mass range | 45~180 degrees |
| Third allowable mass range | 90~180 degrees |
| Fourth allowable mass range | 135~180 degrees |

CONTROL METHOD OF LAUNDRY TREATING APPARATUS

CROSS-REFERENCE TO RELATED APPLICATION

This application claims priority to Korean Patent Application No. 10-2019-0079337, filed on Jul. 2, 2019, the contents of which is hereby incorporated by reference in its entirety.

TECHNICAL FIELD

The present disclosure relate to a laundry treating apparatus and a control method of the same.

BACKGROUND

Laundry treating apparatuses may include a cabinet defining an appearance of the apparatus, a tub installed in the cabinet, a drum rotatably installed in the tub to wash laundry, and a motor to rotate the drum. The motor has a rotating shaft that extends through the tube and is coupled to the drum.

As the drum rotates, the drum may lose dynamic equilibrium (dynamic balance) depending on a position of laundry disposed therein. "Dynamic equilibrium" means a state that, during rotation of a rotating body, centrifugal force of the rotating body or a moment caused by the centrifugal force becomes zero with respect to the axis of rotation. In the case of a rigid body, dynamic equilibrium is maintained when mass of the rigid body is evenly distributed about the axis of rotation.

Dynamic equilibrium of a laundry treating apparatus may be considered as being achieved when the mass distribution of laundry about an axis of rotation of a drum that contains laundry falls within an allowable range during rotation of the drum (e.g., a state in which the drum rotates within an allowable amplitude range of vibration). For example, the dynamic equilibrium in a laundry treating apparatus may be lost (i.e., a state of unbalance) when that mass distribution of laundry about the axis of rotation of a drum is non-uniform during rotation of the drum.

The drum that is rotating in the state of the unbalance may vibrate, and the vibration of the drum may be transferred to the tub or cabinet, causing noise. The vibration of the drum tends to increase as the rotational speed of the drum rises. Some laundry treating apparatuses implement unbalance sensing mechanisms that determines whether unbalance is allowable for a high rotational speed of the drum before rotating the drum at a high rotational speed.

Such unbalance sensing mechanisms may sense variation in the drum rotational speed and estimate the weight (i.e., unbalance (UB) mass) and location (UB mass location) of the clothes or laundry which cause unbalance based on the sensed variation. Specifically, the rotational speed of the drum that is rotating in the unbalance state is the highest when the UB mass passes the lowermost point of a drum rotation locus and the lowest when the UB mass or the laundry that causes the unbalance passes the uppermost point of the drum rotation locus. As the UB mass is increasing more and more, the unbalance of the rotational speed is getting higher. Accordingly, a controller of the laundry treating apparatus may estimate the location of the UB mass and the size of the UB mass based on the sensed variation in the drum rotational speed.

However, these unbalance sensing methods may fail to determine the precise location and size of the UB mass. In other words, even when the drum is rotated based on determining that the location and size of the UB mass is proper using these unbalance sensing methods to allow the high rotational speed of the drum, the vibration of the drum that is rotated at the high rotational speed may be out of an allowable range, which is different from what is estimated (e.g., a problem of stopping the drum rotation). Such a problem occurs because the unbalance sensing methods described above detect the sum of vector values in a centrifugal force that acts on the UB mass during the rotation of the drum.

When the upper UB mass and lower UB mass having the same size are positioned at respective upper and lower ends of a drum circumferential surface in symmetry with respect to a drum rotating shaft as shown in FIG. 8A, the centrifugal force acting on the upper UB mass and the centrifugal force acting on the lower UB mass face in the opposite direction. The sum of a centrifugal force vector acting on the upper UB mass L1 and a centrifugal force vector acting on the lower UB mass L2 will be zero (there will be almost no variation in the drum rotational speed) such that the unbalance sensing methods described above will determine that the degree of the unbalance is proper enough to allow the high rotation umber of the drum.

However, the above-noted estimation that the drum is in the dynamic balance state is only valid in a situation of FIG. 8B but not valid in a situation of FIG. 8C. When the drum is rotated at a low rotational speed, variation in the rotational speed of the drum in the situation of FIG. 8B may be almost the same with variation in the rotational speed of the drum in the situation of FIG. 8C. In contrast, when the drum is rotated at a high rotational speed, the drum of FIG. 8C may vibrate very irregularly, which is different from the drum of FIG. 8B.

Accordingly, these unbalance sensing methods can fail to precisely determine the size and location of the UB mass in an actual situation when the UB mass is distributed in a drum front area DF and a drum rear area DR (e.g., the situation of FIG. 8C). Accordingly, the laundry treating apparatuses using these unbalance sensing methods can generate more noise and vibration that occur in a cycle requiring the high rotational speed of the drum (e.g., a spinning cycle), or can increase a duration time of the spinning cycle (e.g., in a laundry treating apparatus configured to re-start the spinning cycle after pausing the spinning cycle in case of a big vibration).

SUMMARY

Implementations of the present disclosure provide solutions to address the above-noted and other problems, and provide a laundry treating apparatus which can determine the amount and location of laundry (UB mass and UB mass location) that cause dynamic unbalance of a drum, and further provide a control method of the same.

Implementations of the present disclosure provide a laundry treating apparatus which can determine the mass size that causes the unbalance located in a front area of the drum (front UB mass), the mass size that causes the unbalance located in a rear area of the drum (rear UB mass), and an angle between the front UB mass and the rear UB mass, and further provide a control method of the same.

Implementations of the present disclosure provide a laundry treating apparatus which can determine whether to accelerate the drum based on the front UB mass, the rear UB mass and the angle between the front UB mass and the rear UB mass, and further provides a control method of the same.

Particular implementations of the present disclosure described herein provide a method for controlling a laundry treating apparatus. The laundry treating apparatus may include a tub, a drum, and a sensing unit. The tub defines a space for receiving water and has having a tub front surface and a tub rear surface opposite to the tub front surface. The drum may be disposed in the tub and has a drum front area and a drum rear area opposite to the drum front area. The drum front area may face the tub front surface and the drum rear area may face the tub rear surface.

The sensing unit may be configured to sense movement of the tub. The control method may include rotating the drum at a reference rotational speed, the reference rotational speed that is lower or higher than a resonance rotational speed that causes resonance in the laundry treating apparatus; measuring, using the sensing unit, a front maximum displacement of the tub front surface, a rear maximum displacement of the tub rear surface, and a phase difference between the front maximum displacement and the rear maximum displacement, during the rotation of the drum at the reference rotational speed; determining a front unbalance mass at the drum front area, a rear unbalance mass at the drum rear area, and an angle between the front unbalance mass and the rear unbalance mass, based on the front maximum displacement of the tub front surface, the rear maximum displacement of the tub rear surface, and the phase difference between the front maxim displacement and the rear maximum displacement; and increasing a drum rotational speed to a target rotational speed that is set to be higher than the reference rotational speed and the resonance rotational speed, based on the front unbalance mass and the rear unbalance mass being in an allowable mass range and further on the angle between the first unbalance mass and the second unbalance mass being in an allowable angle range.

In some implementations, the method described herein can optionally include one or more of the following features.

The method may include ceasing to rotate the drum based on the front unbalance mass and the rear unbalance mass being out of the allowable mass range.

The method may include ceasing to rotate the drum based on the angle between the front unbalance mass and the rear unbalance mass being out of the allowable angle range.

The allowable mass range may be set based on ranges of the front unbalance mass and the rear unbalance mass in which a vibration that is generated in the tub falls in an allowable vibration range based on the drum that receives a mass at the drum front area and the drum rear area being rotated at the target rotational speed. The allowable angle range may be an angle between the front unbalance mass and the rear unbalance mass in which the vibration that is generated in the tub falls in the allowable vibration range based on the drum that receives an unbalance mass within the allowable mass range being rotated at the target rotational speed. The allowable angle range may be between 0 and 180 degrees based on a ratio of the front unbalance mass to the rear unbalance mass being 1:5 or less, 2:5 or less, 3:4 or less, or 5:1 or less. The allowable angle range may be between 45 and 180 degrees based on a ratio of the front unbalance mass to the rear unbalance mass being 1:6, 2:6, between 3:5 and 3:6, between 4:3 and 4:5 or between 5:2 and 5:3. The allowable angle range may be between 90 and 180 degrees based on a ratio of the front unbalance mass to the rear unbalance mass being between 1:7 and 3:7, 4:6, between 5:4 and 5:5, or between 6:2 and 6:4. The allowable angle range may be between 135 and 180 degrees based on a ratio of the front unbalance mass to the rear unbalance mass being 4:7, 5:6, 6:1, or 6:5.

The reference rotational speed may be lower than the resonance rotational speed by 25% or more. The reference rotational speed may be 25% lower than a lowest one of (i) a rotational speed that causes a first-axis resonance of the tub front surface, (ii) a rotational speed that causes a second-axis resonance of the tub front surface, (iii) a rotational speed that causes a third-axis resonance of the tub front surface, (iv) a rotational speed that causes a first-axis resonance of the tub rear surface, (v) a rotational speed that causes a second-axis of the tub rear surface, and (vi) a rotational speed that causes a third-axis resonance of the tub rear surface. The reference rotational speed may be higher than the resonance rotational speed by 25% or more, or lower than the target rotational speed. The reference rotational speed may be lower than the target rotational speed, or 25% or more higher than a highest one of (i) a rotational speed that causes a first-axis resonance of the tub front surface, (ii) a rotational speed that causes a second-axis resonance of the tub front surface, (iii) a rotational speed that causes a third-axis resonance of the tub front surface, (iv) a rotational speed that causes a first-axis resonance of the tub rear surface, (v) a rotational speed that causes a second-axis of the tub rear surface, and (vi) a rotational speed that causes a third-axis resonance of the tub rear surface.

Measuring the front maximum displacement, the rear maximum displacement, and the phase difference may include, based on displacement variation of the tub front surface being larger than displacement variation of the tub rear surface with respect to size variation of the front unbalance mass, measuring, as the front maximum displacement of the tub front surface, a maximum value in a numerator of a fraction that is a largest value calculated by dividing one of (i) a first-axis displacement variation of the tub front surface with respect to the size variation of the front unbalance mass, (ii) a second-axis displacement variation of the tub front surface with respect to the size variation of the front unbalance mass, and (iii) a third-axis displacement of the tub front surface with respect to the size variation of the front unbalance mass by one of (a) a first-axis displacement of the tub rear surface with respect to the size variation of the front unbalance mass, (b) a second-axis displacement variation of the tub rear surface with respect to the size variation of the front unbalance mass, and (c) a third-axis displacement of the tub rear surface with respect to the size variation of the front unbalance mass.

Measuring the front maximum displacement, the rear maximum displacement, and the phase difference may include, based on displacement variation of the tub front surface being larger than displacement variation of the tub rear surface with respect to size variation of the front unbalance mass, measuring, as the rear maximum displacement of the tub rear surface, a maximum value in a numerator of a fraction that is a largest value calculated by dividing one of (i) a first-axis displacement variation of the tub rear surface with respect to the size variation of the rear unbalance mass, (ii) a second-axis displacement variation of the tub rear surface with respect to the size variation of the rear unbalance mass, and (iii) a third-axis displacement of the tub rear surface with respect to the size variation of the rear unbalance mass by one of (a) a first-axis displacement of the tub front surface with respect to the size variation of the rear unbalance mass, (b) a second-axis displacement variation of the tub front surface with respect to the size variation of the rear unbalance mass, and (c) a third-axis displacement of the tub front surface with respect to the size variation of the rear unbalance mass.

Measuring the front maximum displacement, the rear maximum displacement, and the phase difference may include, based on displacement variation of the tub rear surface being larger than displacement variation of the tub front surface with respect to size variation of the front unbalance mass, measuring, as the front maximum displacement of the tub front surface, a maximum value in a numerator of a fraction that is a largest value calculated by dividing one of (i) a first-axis displacement variation of the tub rear surface with respect to the size variation of the front unbalance mass, (ii) a second-axis displacement variation of the tub rear surface with respect to the size variation of the front unbalance mass, and (iii) a third-axis displacement of the tub rear surface with respect to the size variation of the front unbalance mass by one of (a) a first-axis displacement of the tub front surface with respect to the size variation of the front unbalance mass, (b) a second-axis displacement variation of the tub front surface with respect to the size variation of the front unbalance mass, and (c) a third-axis displacement of the tub front surface with respect to the size variation of the front unbalance mass.

Measuring the front maximum displacement, the rear maximum displacement, and the phase difference may include, based on displacement variation of the tub front surface being larger than displacement variation of the tub rear surface with respect to size variation of the rear unbalance mass, measuring, as the rear maximum displacement of the tub rear surface, a maximum value in a numerator of a fraction that is a largest value calculated by dividing one of (i) a first-axis displacement variation of the tub front surface with respect to the size variation of the rear unbalance mass, (ii) a second-axis displacement variation of the tub front surface with respect to the size variation of the rear unbalance mass, and (iii) a third-axis displacement of the tub front surface with respect to the size variation of the rear unbalance mass by one of (a) a first-axis displacement of the tub rear surface with respect to the size variation of the rear unbalance mass, (b) a second-axis displacement variation of the tub rear surface with respect to the size variation of the rear unbalance mass, and (c) a third-axis displacement of the tub rear surface with respect to the size variation of the rear unbalance mass.

Measuring the front maximum displacement, the rear maximum displacement, and the phase difference may include determining a maximum first-axis displacement of the tub front surface as the front maximum displacement of the tub front surface; and determining a maximum second-axis displacement of the tub rear surface as the rear maximum displacement of the tub rear surface.

The tub may include a tub opening defined at the tub front surface. The sensing unit may be configured to detect three-axis acceleration and three-axis angular velocity.

Implementations of the present disclosure may provide a control method of a laundry treating apparatus including a rotating step for rotating a drum at a preset reference rotational speed; a measuring step for measuring a phase difference between the two maximum displacements; a determining step for determining an angle from a rotating shaft of the drum to the rear UB mass and the front UB mass based on the measured maximum displacements and the phase difference; and a rotating step for rotating the drum at a higher rotational speed than the reference rotational speed, when the two UB masses and the phase difference between the two UB masses are in a preset allowable mass range and an allowable angle range.

When one of the two UB masses is out of the allowable mass range or the phase difference between the two UB masses are out of the allowable angle range, the rotation of the drum is paused.

Implementations of the present disclosure may also provide a control method of a laundry treating apparatus including a tub defining a predetermined space for storing water and having a tub opening formed in a front surface; a drum rotatably provided in the tub and configured to hold laundry; and a sensing unit configured to sense three-shaft acceleration and three-angle angle velocity, the control method including a maintaining step for rotating the drum at a reference rotational speed that is set to be a lower or a higher rotation than a rotational speed causing resonance in the laundry treating apparatus; a measuring step for controlling the sensing unit to measure the maximum displacement of a tub front surface, the maximum displacement of a tub rear surface and a phase difference between the maximum displacements during the rotation of the drum at the reference rotational speed; a determining step for determining a front UB mass located in a drum front area, a rear UB mass located in a drum rear area and an angle between the UB masses based on the maximum displacement of the tub front surface, the maximum displacement of the tub rear surface and the phase difference between the maxim displacements; and an accelerating step for accelerating the drum rotational speed to a target rotational speed that is set to be higher than the reference rotational speed and the rotational speed causing resonance, when the front UB mass and the rear UB mass are in a preset allowable mass range and an angle between the two UB masses is in an allowable angle range.

The drum rotation may be paused when the front UB mass and the rear UB mass are out of the allowable mass range.

The drum rotation may be paused when the angle between the front UB mass and the rear UB mass are out of the allowable angle range.

The allowable mass range may be set as a range of the front UB masses and a range of the rear UB mass in which the vibration generated in the tub is not out of a predetermined allowable vibration range, when the drum having a mass secured to the front and rear spaces of the drum is rotated at the target rotational speed.

The allowable angle range may be set to as an angle between the front UB mass and the rear UB mass in which the vibration generated in the tub is not out of the allowable vibration range, when the drum having a UB mass within the allowable mass range is rotated at the target rotational speed.

The allowable angle range may be set to be 0~180 degrees, when a ratio of the front UB mass to the rear UB mass is 1:5 or less, 2:5 or less, 3:4 or less or 5:1 or less.

The allowable angle range may be set to be 45~180 degrees, when a ratio of the front UB mass to the rear UB mass is 1:6, 2:6, 3:5~3:6, 4:3~4:5 or 5:2~5:3.

The allowable angle range may be set to be 90~180 degrees, when a ratio of the front UB mass to the rear UB mass is 1:7~3:7, 4:6, 5:4~5:5 or 6:2~6:4.

The allowable angle range may be set to be 135~180 degrees, when a ratio of the front UB mass to the rear UB mass is 4:7, 5:6, 6:1 or 6:5 or more.

The reference rotational speed may be set to be a rotational speed that is lower than a rotational speed causing resonance in the laundry treating apparatus by 25% or more.

The reference rotational speed may be set to be a rotational speed that is 25% lower than the lowest one of a rotational speed causing a vertical-direction resonance of the tub front surface, a rotational speed causing a horizontal-direction resonance of the tub front surface, a back-and-forth direction resonance of the tub front surface, a rotational speed causing a vertical-direction resonance of the tub front surface, a rotational speed causing a horizontal-direction of the tub front surface and a rotational speed causing a back-and-forth-direction resonance of the tub front surface.

The reference rotational speed may be set to be a rotational speed that is higher than a rotational speed causing resonance in the laundry treating apparatus by 25% or more or lower than the target rotational speed.

The reference rotational speed is set to be a rotational speed that is lower than the target rotational speed or 25% or more higher than the highest one of a rotational speed causing a vertical-direction resonance of the tub front surface, a rotational speed causing a horizontal-direction resonance of the tub front surface, a back-and-forth direction resonance of the tub front surface, a rotational speed causing a vertical-direction resonance of the tub front surface, a rotational speed causing a horizontal-direction of the tub front surface and a rotational speed causing a back-and-forth-direction resonance of the tub front surface.

When displacement variation of the tub front surface with respect to size variation of the front UB mass is larger than displacement variation of the tub rear surface, the measuring step may measure the maximum value of the displacement located in a numerator of a fraction having the largest value gained by dividing one of the vertical-direction displacement variation of the tub front surface with respect to the size variation of the front UB mass, the horizontal-direction displacement variation of the tub front surface with respect to the size variation of the front UB mass, and the back-and-forth-direction displacement of the tub front surface with respect to the size variation of the front UB mass by one of the vertical-direction displacement of the tub rear surface with respect to the size variation of the front UB mass, the horizontal-direction displacement variation of the tub rear surface with respect to the size variation of the front UB mass and the back-and-forth-direction displacement of the tub rear surface with respect to the size variation of the front UB mass as the maximum displacement of the tub front surface.

When displacement variation of the tub front surface with respect to size variation of the front UB mass is larger than displacement variation of the tub rear surface, the measuring step measures the maximum value of the displacement located in a numerator of a fraction having the largest value gained by dividing one of the vertical-direction displacement variation of the tub rear surface with respect to the size variation of the rear UB mass, the horizontal-direction displacement variation of the tub rear surface with respect to the size variation of the rear UB mass, and the back-and-forth-direction displacement of the tub rear surface with respect to the size variation of the rear UB mass by one of the vertical-direction displacement of the tub front surface with respect to the size variation of the rear UB mass, the horizontal-direction displacement variation of the tub front surface with respect to the size variation of the rear UB mass when displacement variation of the tub rear surface with respect to size variation of the front UB mass is larger than displacement variation of the tub front surface, the measuring step measures the maximum value of the displacement located in a numerator of a fraction having the largest value gained by dividing one of the vertical-direction displacement variation of the tub rear surface with respect to the size variation of the front UB mass, the horizontal-direction displacement variation of the tub rear surface with respect to the size variation of the front UB mass, and the back-and-forth-direction displacement of the tub rear surface with respect to the size variation of the front UB mass by one of the vertical-direction displacement of the tub front surface with respect to the size variation of the front UB mass, the horizontal-direction displacement variation of the tub front surface with respect to the size variation of the front UB mass and the back-and-forth-direction displacement of the tub front surface with respect to the size variation of the front UB mass as the maximum displacement of the tub front surface.

When displacement variation of the tub front surface with respect to size variation of the rear UB mass is larger than displacement variation of the tub rear surface, the measuring step measures the maximum value of the displacement located in a numerator of a fraction having the largest value gained by dividing one of the vertical-direction displacement variation of the tub front surface with respect to the size variation of the rear UB mass, the horizontal-direction displacement variation of the tub front surface with respect to the size variation of the rear UB mass, and the back-and-forth-direction displacement of the tub front surface with respect to the size variation of the rear UB mass by one of the vertical-direction displacement of the tub rear surface with respect to the size variation of the rear UB mass, the horizontal-direction displacement variation of the tub rear surface with respect to the size variation of the rear UB mass and the back-and-forth-direction displacement of the tub rear surface with respect to the size variation of the rear UB mass as the maximum displacement of the tub rear surface.

The measuring step may determine the maximum vertical-direction displacement of the tub front surface as the maximum displacement of the tub front surface and the maximum horizontal-direction displacement of the tub rear surface as the maximum displacement of the tub rear surface.

The measuring step may determine the maximum back-and-forth-direction displacement of the tub rear surface as the maximum displacement of the tub front surface and the maximum horizontal-direction displacement of the tub rear surface as the maximum displacement of the tub rear surface.

According to implementations of the present disclosure, the laundry treating apparatus has one or more of the following advantages.

First, some implementations of the present disclosure can provide a laundry treating apparatus which may determine the amount and location of laundry (UB mass and UB mass location) that cause dynamic unbalance of a drum, and a control method of the same.

In addition, some implementations of the present disclosure can provide a laundry treating apparatus which may determine the mass size that causes the unbalance located in a front area of the drum (front UB mass), the mass size that causes the unbalance located in a rear area of the drum (rear UB mass), and an angle between the front UB mass and the rear UB mass, and a control method of the same.

In addition, some implementations of the present disclosure can provide a laundry treating apparatus which may determine whether to accelerate the drum based on the front UB mass, the rear UB mass, and the angle between the front UB mass and the rear UB mass, and a control method of the same.

BRIEF DESCRIPTION OF THE DRAWINGS

The present disclosure will become more fully understood from the detailed description given herein below and the accompanying drawings, which are given by illustration only, and thus are not limitative of the present disclosure, and wherein:

FIG. 4 is a diagram illustrating one example of a method for estimating a front UB mass, a rear UB mass and a phase difference between the two UB masses;

DETAILED DESCRIPTION

Reference will now be made in detail to the preferred implementations of the present disclosure, examples of which are illustrated in the accompanying drawings. All terms disclosed in this specification correspond to general terms understood by persons having ordinary skill in the art to which the present disclosure pertains unless the terms are specially defined. If the terms disclosed in this specification conflict with general terms, the terms may be understood on the basis of their meanings as used in this specification.

Figure 1:
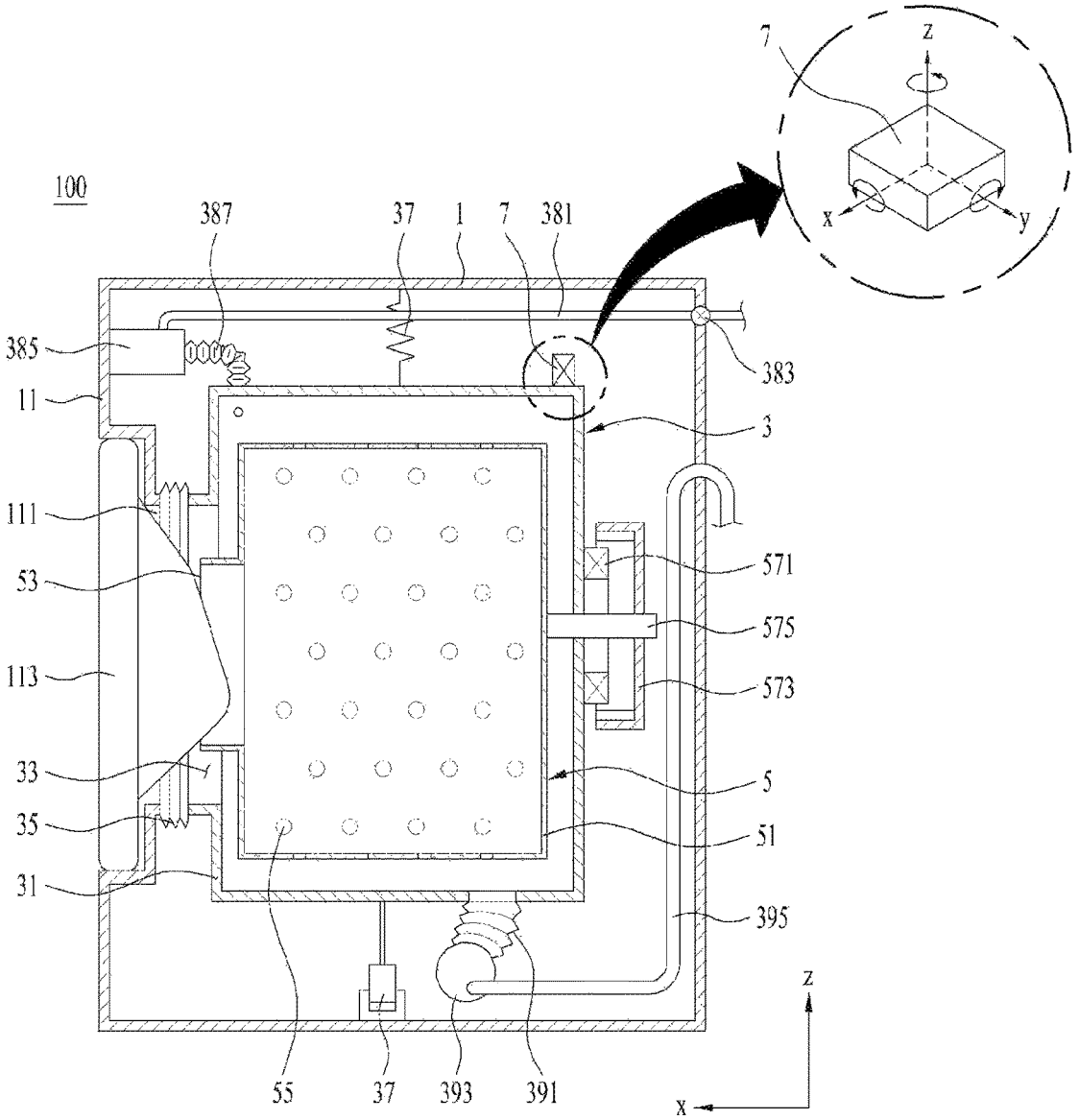
FIG. 1 is a view showing one example of a laundry treating apparatus according to implementations of the present disclosure.

As shown in FIG. 1, the laundry treating apparatus includes a cabinet 1, a tub 2 provided at the cabinet 1 to hold water therein, a drum 3 rotatably provided in the tub 2 to receive laundry, a drive unit 5 configured to rotate the drum, and a sensing unit 7 configured to detect location variation of the tub 3.

FIG. 1 illustrates a washing machine that is configured to wash clothes (hereinafter, laundry) by means of water. In implementations where a laundry apparatus has washing and drying functions, an air supply unit configured to supply heated-air to the tub 3 can be provided in the cabinet 1.

The cabinet 1 includes an introduction opening 111 for allowing introduction and retrieval of laundry, and a door 12 rotatably coupled to the cabinet to open and close the introduction opening 111.

The tub 2 may include a tub body 31 formed in a cylinder shape. The tub body 31 may be fixed in the cabinet by means of a tub support part 37. The tub support part 37 may include a damper configured to fix a lower circumferential surface of the tub body to the cabinet, and a spring configured to fix an upper circumferential surface of the tub to the cabinet.

The tub body 31 has a tub opening 33 that is formed in a front surface, in communication with the introduction opening 111. The tub opening 33 and the cabinet opening 111 may be connected with each other via a gasket 35. The gasket 35 may prevent water from leaking outside the tub body and vibration from being transmitted to a front panel 11 from the tub body.

The tub body 31 may be supplied with water by a water supply unit and the water held in the tub body may be discharged outside the cabinet 1 by a water discharge unit. The water supply unit may include a water supply pipe 381 provided to connect the tub body 31 to a water supply source, and a water supply valve 383 configured to open and close the water supply pipe 381 based on a control signal of a controller.

A detergent supply unit may be further provided in the water supply pipe 381. The detergent supply unit may include a storage 385 that defines a predetermined space for storing a washing detergent in a state of being connected with the water supply pipe 381. The detergent supply unit can further include a detergent supply pipe 387 provided to connect the storage 385 to the tub body 31.

The water discharge unit may include a pump 393, a first water discharge pipe 391 configured to guide the water to the pump 393 from the tub body 31, and a second water discharge pipe 395 configured to discharge the water discharged from the pump 393 outside the cabinet 1.

The drum 5 may include a drum body 51 formed in a cylinder shape. The volume of the drum body 51 may be predetermined so as to be rotatable in the tub body 31.

A drum opening 53 may be provided in a front surface of the drum body 31 and communicate with the introduction opening 111. A plurality of through-holes may be provided in a circumferential surface of the drum body 51 to facilitate communication between the drum inside and the drum outside.

Accordingly, a user may load laundry into the drum body 51 via the introduction opening 111 or unload the laundry out of the drum body 51 via the introduction opening 111. The water held in the tub body 31 may be supplied to the laundry held in the drum body 51 via the plurality of the through-hole 55.

The drum body 51 may be rotated by the drive unit. The drive unit may include a stator 571, a rotor 573, and a rotating shaft 575. The stator 571 can be secured to a rear surface of the tub 31 and configured to form a rotating magnetic field. The rotor 573 can be provided outside the tub body and configured to be rotatable by the rotating magnetic field. The rotating shaft 575 can be provided through a rear surface of the tub body 31 and configured to connect the rear surface of the drum body 51 to the rotor 573.

The sensing unit 7 may be secured to the tub body 31 and configured to sense location variation of the tub body 31. The sensing unit 7 provided in the laundry treating apparatus according to implementations of the present disclosure may be a device that is configured to sense three-axis acceleration of the tub body 31 (e.g., X-axis acceleration, Y-axis acceleration and Z-axis acceleration) and three-axis angular velocities of the tub body 31. (e.g., an X-axis angular velocity, a Y-axis angular velocity and a Z-axis angular velocity).

FIG. 1 illustrates one example of the sensing unit 7 that is secured in a space (hereinafter, an upper space) located above a horizontal line passing the rotating shaft 575 with respect to a circumferential surface of the tub body 31.

When secured in the upper space of the tub body, the sensing unit 7 may be located in a rear area of the tub body in the upper space (or an area that is closer to the rear surface of the tub body than the tub opening). In the laundry treating apparatus having the drum 3 that is fixed to the rotating shaft 575 provided through the rear surface of the tub, the vibration of the tub body may be getting less as getting closer to the rotating shaft 575. Accordingly, the size and number of the data input to the sensing unit 7 may be minimized when the sensing unit 7 is provided in the rear area out of the upper space of the tub body.

Figure 2:
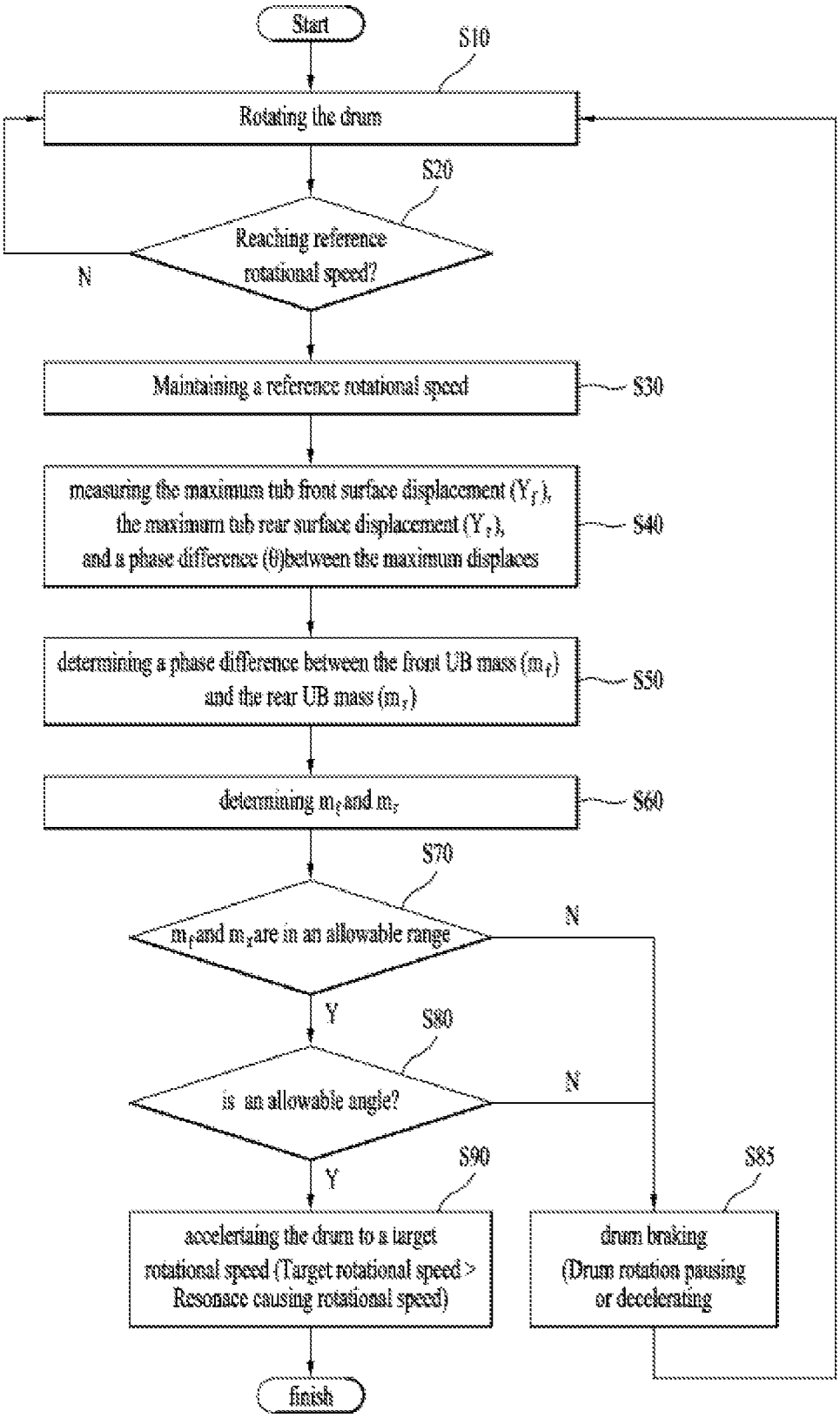
FIG. 2 is a diagram illustrating one example of a control method for a laundry treating apparatus according to implementations of the present disclosure.

FIG. 2 illustrates one example of a controlling method for the laundry treating apparatus having above-noted structures. The control method for the laundry treating apparatus according to implementations of the present disclosure may include a rotating step S10 for rotating the drum at a preset reference rotational speed. The rotating step S10 starts when the controller supplies an electric current to the stator 571.

In the rotating step S10, the controller determines whether the rotational speed of the drum reaches a reference rotational speed in rear time or periodically S20. The rotational speed of the drum 5 may be measured by a rotational speed sensing unit and one example of the rotational speed sensing unit may be a Hall Effect sensor including a plurality of magnets in which magnetic poles are alternately arranged to sense magnetic forces.

When the drum rotational speed reaches the reference number S20, the control method may implement a maintaining step S30 for maintaining the drum rotational speed to be the reference rotational speed for a preset reference time period. The maintaining step S30 may be implemented once the controller controls the amount of the electric currents supplied to the stator 571.

During the maintaining step S30, the control method may implement a measuring step S40 for measuring the maximum displacement Yf of the tub front surface, the maximum displacement Yr of the tub rear surface and a phase difference θ between the two displacements. The measuring step S40 may calculate the maximum displacement Yf, the maximum displacement Yr of the tub rear surface and the phase difference θ between the two displacements.

Figure 3A:
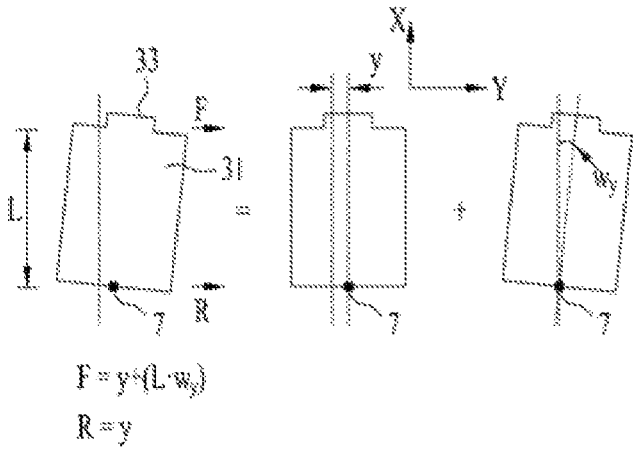
FIG. 3A is a diagram illustrating an example method for estimating displacement of tub front and rear surfaces by means of a sensing unit that is coupled to a rear surface of a tub.

FIG. 3A illustrates an example process for determining a displacement of the tub front surface and a displacement of the tub rear surface by means of the sensing unit 7 fixed to the tub body 31. As shown in FIG. 3A, the displacement of the tub body 31 may be represented by the sum of a horizontal displacement (or a Y-axis direction displacement) of the tub body 31 and a rotation displacement of the tub body with respect to the sensing unit 7.

As mentioned above, the sensing unit 7 according to the present disclosure may be configured to sense the acceleration of each axis (X, Y and Z axes) and an angular velocity of each axis. When the sensing unit 7 measures and integrates the accelerations and the angular velocities of the axes (X, Y and Z axes), the controller may determine displacements of the axes and rotation angles (ωx, ωy and ωz) of the axes.

Accordingly, the tub front surface displacement F may be the sum of rotation displacements of a horizontal displacement y of the tub front surface that is moved along Y-axis and a rotation displacement of the tub front surface that rotates with respect to the sensing unit 7. The tub rear surface displacement R may be a horizontal displacement y of the tub rear surface that is moved along Y-axis.

Figure 3B:
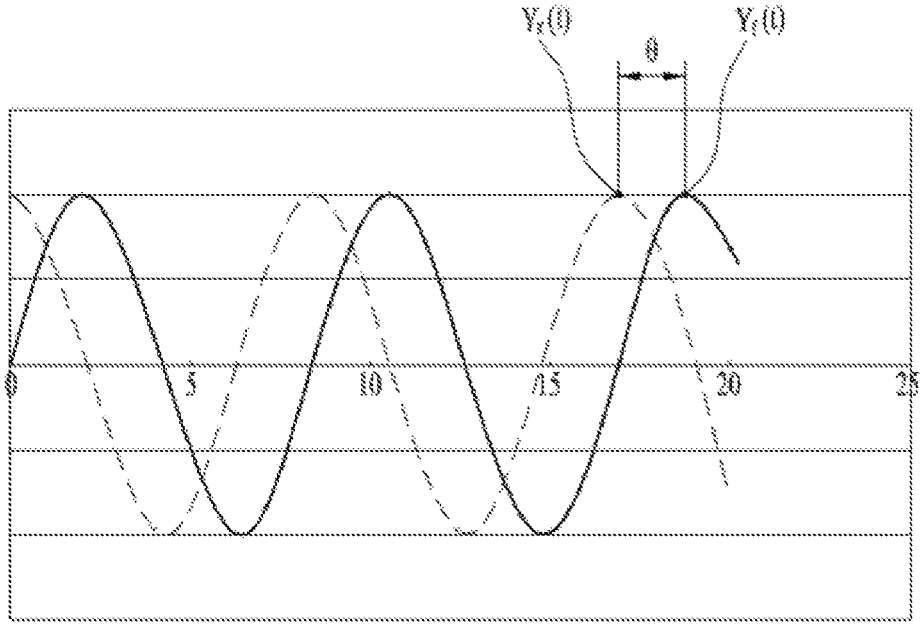
FIG. 3B is a diagram illustrating one example of a tub front surface displacement function and a tub rear surface displacement function with respect to the time.

Meanwhile, when the sensing unit 7 transmits tub front surface displacement data and tub rear surface displacement data to the controller in real time, the controller may gain a displacement function Yf(t) of the tub front surface, a displacement function Yr(t) of the tub rear surface with respect to the time as shown in FIG. 3B. When identifying the displacement function Yf(t) of the tub front surface and the displacement function Yr(t) of the tub rear surface, the controller may determine the maximum displacement Yf of the tub front surface, the maximum displacement Yr of the tub rear surface, and the phase difference θ between the maximum displacements based on the gained displacement functions.

As shown in FIG. 2, once identifying the maximum displacement Yf of the tub front surface, the maximum displacement Yr of the tub rear surface, and the phase difference θ between the maximum displacements that are sensed by the sensing unit 7, the control method according to implementations of the present disclosure may implement a phase difference θ determining step S50 for determining a phase different between a front UB mass mf, a rear UB mass mr, and further implement a UB mass determining step for determining the UB masses mf and mr.

The vibration of the tub body 31 is generated by the vibration of the drum body 51 transmitted via the rotating shaft 575. The size of the tub vibration is proportional to the size of the drum vibration such that the size or location of the mass that causes unbalance in the drum 51 may be estimated based on the vibration of the tub body 31.

For example, the amount (i.e., the front UB mass) of the laundry located in a front space of the drum body (e.g., a space closer to the drum opening in the drum body) can relate to the maximum displacement of the tub front surface. The amount (i.e., the rear UB mass) of the laundry located in a rear space of the drum body (e.g., a space closer to a rear surface of the drum in the drum body) can relate to the maximum displacement of the tub rear surface. A location between the front UB mass and the rear UB mass (i.e., an angle at which the two UB masses are spaced apart with respect to the rotating shaft) can relate to the phase difference between the two maximum displacements.

Here, the maximum displacement of the tub front surface and the maximum displacement of the tub rear surface may result from an effect of the front UB mass vibrating the tub and an effect of the rear UB mass that vibrate the tub (as a result of their interaction with the drum body). Accordingly, the unbalance sensing methods that are based on the assumption that the maximum displacement of the tub front surface is caused only by the front UB mass, while the maximum displacement of the tub rear surface may be caused only by the rear UB mass, may estimate the precise size of the mass causing unbalance.

In addition, the phase difference θ between the maximum displacement of the tub front surface and the maximum displacement of the tub rear surface also results from the interaction between the front UB mass and the rear UB mass. Accordingly, it is difficult to determine that the phase difference θ between the two maximum displacements precisely reflects an angle between the front UB mass and the rear UB mass (i.e., an angle of the two UB masses spaced apart with respect to the rotating shaft). Accordingly, unbalance sensing methods that estimates the front UB mass only based on the maximum displacement Yf of the tub front surface and the rear UB bass only based on the maximum displacement Yr of the tub rear surface and determines the phase difference between the two maximum displacements is the angle between the two UB masses may have a disadvantage of difficulty in precisely determining the size and location of the actual UB mass.

Referring to FIG. 2, the phase difference determining step S50 and the UB mass determining step S60 may determine the maximum displacements of the tub front surface and the tub rear surface that are measured based on the result of the interaction, the actual weight (the front UB mass) of the laundry causing unbalance in the drum front space, the actual weight (the rear UB mass) of the laundry causing unbalance in the drum rear space, and the actual angle between the two UB masses spaced apart with respect to the rotating shaft 575 of the drum (in other words, the steps for estimating the UB masses and the angle between the two masses after excluding the impact of the interaction.)

FIG. 4 illustrates the maximum displacement Yf of the tub front surface and the maximum displacement Yr of the tub rear surface in consideration of the interaction between the front UB mass mf located in the front space of the drum body 51 and the rear UB mass mr located in the rear space of the drum body 51. Φ1 means an angle of the maximum displacement Yr of the tub rear surface spaced apart from the rear UB mass mr. Φ2 means an angle of the maximum tub front surface displacement Yf spaced apart from the rear UB mass mr. Φ3 means an angle of the maximum tub rear surface displacement Yr spaced apart from the front UB mass mf. Φ4 means an angle of the maximum tub front surface displacement Yf spaced apart from the front UB mass mf.

Meanwhile, the maximum tub rear surface displacement Yr may be the sum (the vector sum) of a displacement Arf caused in the tub rear surface by the front UB mass mf and a displacement Arr caused in the tub rear surface by the rear UB mass mr. Further, the maximum tub front surface displacement Yf may be the sum (the vector sum) of a displacement Aff caused in the tub front surface by the front UB mass mf and a displacement Afr caused in the tub front surface by the rear UB mass mr.

Figure 5A:
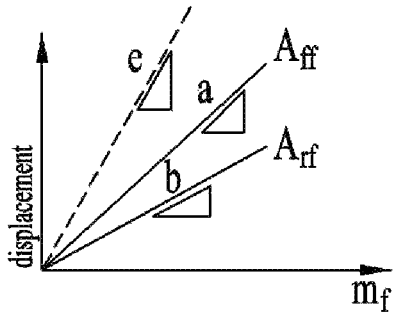
FIG. 5A is a diagram illustrating a relation between a tub front surface displacement caused by the front UB mass mf and a tub rear surface displacement caused by the front UB mass mr.

The displacement Aff generated in the tub front surface by the front UB mass mf and the displacement Arf generated in the tub rear surface by the front UB mass mf has a relation shown in FIG. 5A. The displacement Arr generated in the tub rear surface by the rear UB mass mr has a relation shown in FIG. 5B.

For example, when the displacement Aff of the tub front surface and the displacement Art of the tub rear surface while rotating the drum body holding the laundry only in the front space at a constant rotational speed, the tub front surface displacement Aff and the tub rear surface displacement Arf that are generated by the front UB mass mf may be proportional to the size of the front UB mass mf.

Also, when the displacement Afr of the tub front surface and the displacement Arr of the tub rear surface while rotating the drum body holding the laundry only in the rear space at a constant rotational speed, the tub front surface displacement Mr and the tub rear surface displacement Arr that are generated by the rear UB mass mr may be proportional to the size of the rear UB mass mr.

Accordingly, a slope (a and b) of each displacement Aff and Arf generated by the front UB mass and a slope (c and d) of each displacement Afr and Arr generated by the rear UB mass may be a constant value that is determined based on the structure of the laundry treating apparatus (the structure of the vibration system).

In this instance, the phase difference between the two UB masses, the front UB mass mf and the rear UB mass mr may be gained by applying the maximum displacement Yr and Yf and the phase difference θ, that are measured in the measuring step S40, to a law of sines and a sine of the sum.

As shown in FIG. 4, Φ1 and Φ3 are calculated from the low of the sines (e1 and e3) and the sine of the sum (e2 and e4). The phase difference between the two UB masses may be determined as the sum of Φ1 and Φ3 (e5). The front UB mass mf and the rear UB mass mr may be determined as a value calculated by assigning Φ1 and Φ3 and the phase difference to the low of the sines (e6).

As shown in FIG. 2, once the front UB mass mf, the rear UB mass mr and the phase difference between the two UB masses are determined in the phase difference determining step S50 and the UB mass determining step S60 mentioned above, the control method may implement an expecting step S70, S80 and S90 for expecting a vibration range of the tub body when rotating the drum at a higher rotational speed than the reference rotational speed.

In some implementations, the expecting step for expecting the vibration range of the tub body may estimate whether the vibration of the tub body is out of an allowable vibration range.

The expecting step for expecting the vibration range of the tub body may include a first comparing step S70 for determining whether the front UB mass mf and the rear UB mass mr are in an allowable mass range; and a second comparing step S80 for determining whether the phase difference is in an allowable angle range. The first comparing step S70 and the second comparing step S80 may be implemented sequentially.

When the drum body is rotated at a high rotational speed in a state where the front UB mass mf and the rear UB mass mr are a specific value or less, it is checked that the phase difference between the two UB masses determines whether the vibration of the drum body is out of the allowable vibration range based on an experiments.

It is also checked based on the same experiment that the vibration of the drum body is out of the allowable vibration range regardless of the phase difference between the two UB masses, when the drum body is rotated at a high rotational speed in a state where the front UB mass mf and the rear UB mass mr are more than a specific value.

Figures 6A, 6B:
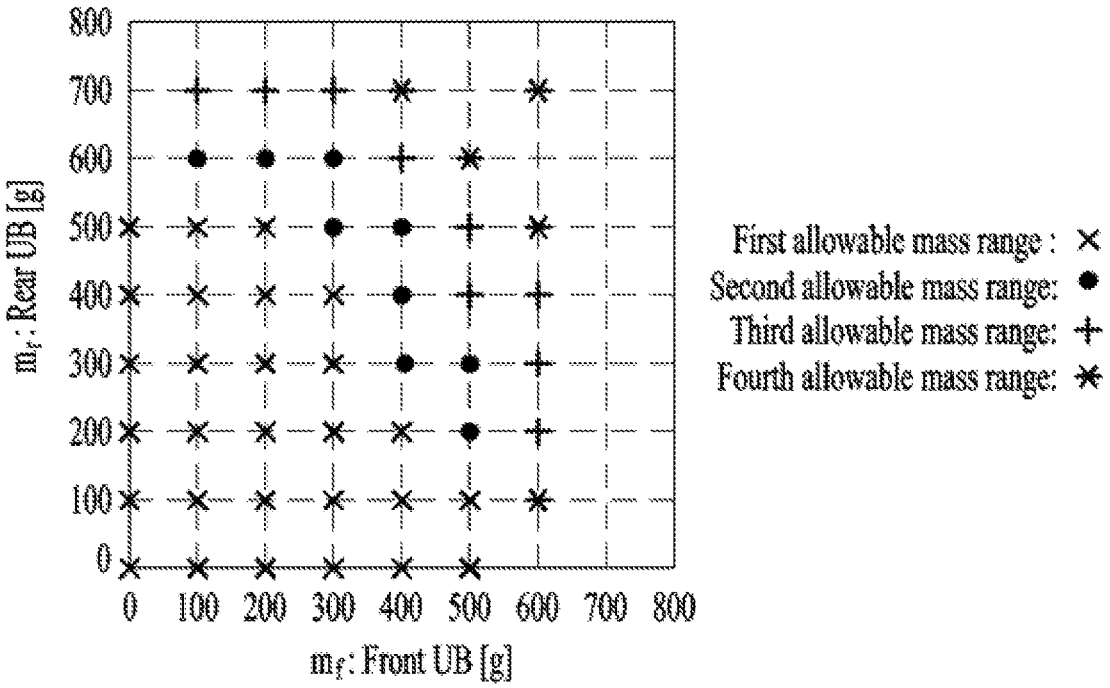
FIGS. 6A and 6B are diagrams illustrating one example of a reference value that is used in determining a degree of drum unbalance based on the measured front UB mass mr, the measured rear UB mass mr and the measured phase a difference between the two UB masses.

FIGS. 6A and 6B are made based on the result of the above-noted experiment and illustrates one example of an allowable angle range for each allowable mass range. FIGS. 6A and 6B illustrate the measured data of the vibration generated in the tub body while rotating the drum body at the reference rotational speed after fixing the front UB mass and the rear UB mass that have respective predetermined phase differences in the front and rear spaces of the drum body. The data shown in FIGS. 6A and 6B means what is shown as follows.

When the front UB mass mf and the rear UB mass mr fall within a first allowable mass range, a phase difference between the two UB masses is 0~180 and then it means that the vibration of the tub is in the allowable vibration range during the rotation of the drum at the high rotational speed. When the phase difference between the two UB masses is 0~180 degrees (in the allowable angle range), the first allowable mass range is as follows:

TABLE 1

| Rear UB mass (mr) | Front UB mass (mf) |
|---|---|
| 0~100 g | 0~500 g |
| 200 g | 0~400 g |

TABLE 1-continued

| Rear UB mass (mr) | Front UB mass (mf) |
|---|---|
| 300~400 g | 0~300 g |
| 500 g | 0~200 g |

When a phase difference between the UB masses may be 45~180 degrees in case the front UB mass and the rear UB mass falls in a second allowable mass range, the vibration of the tub is in the allowable vibration range. The second allowable mass range that causes no problem during the drum rotation at the high rotational speed when the phase difference is in the range of 45~180 degrees is as follows:

TABLE 2

| Rear UB mass | Front UB mass |
|---|---|
| 200 g | 500 g |
| 300 g | 400~500 g |
| 400 g | 400 g |
| 500 g | 300~400 g |
| 600 g | 100~300 g |

Meanwhile, when the phase difference between the UB masses falls in a third allowable mass range that is 90~180 degrees, the vibration of the tub during the rotation of the drum at the high rotational speed may be in the allowable vibration range. The third allowable mass range that causes no problem during the drum rotation at the high rotational speed when the phase difference is in the range of 90~180 degrees is as follows:

TABLE 3

| Rear UB mass | Front UB mass |
|---|---|
| 200~300 g | 600 g |
| 400 g | 500~600 g |
| 500 g | 500 g |
| 600 g | 400 g |
| 700 g | 100~300 g |

When the phase difference between the UB masses falls in a fourth allowable mass range that is 135~180 degrees, the tub vibration is during the drum rotation at the high rotational speed is in the allowable vibration range. The fourth allowable mass range that causes no problem during the drum rotation at the high rotational speed when the phase difference is in the range of 135~180 degrees is as follows:

TABLE 4

| Rear UB mass | Front UB mass |
|---|---|
| 100 g | 600 g |
| 500 g | 600 g |
| 600 g | 500 g |
| 700 g | 400 g |

In generalizing the result of FIGS. 6A and 6B, when a ratio of the front UB mass to the rear UB mass is 1:5 or less (when the front UB mass is 0~100 g, the rear UB mass is 500 g or less), 2:5 or less (when the front UB mass is 200 g, the rear UB mass is 500 g or less), 3:4 or less (when the front UB mass is 300 g, the rear UB mass is 400 or less), 4:2 or less (when the front UB mass is 400 g, the rear UB mass is 200 or less), or 5:1 or less (when the front UB mass is 500 g, the rear UB mass is 100 g or less), the allowable angle range may be set to be 0~180 degrees.

Alternatively, when the ratio of the front UB mass to the rear UB mass is 1:6 (when the front UB mass is 100 g, the rear UB mass is 600 g), 2:6 (when the front UB mass is 200 g, the rear UB mass is 600 g), 3:5 to 3:6 (when the front UB mass is 300 g, the rear UB mass is 500 g–600 g), 4:3 to 4:5 (when the front UB mass is 400 g, the rear UB mass is 300 g~500 g) or 5:2 to 5:3 (when the front mass is 500 g, the rear UB mass is 200 g~300 g), the allowable angle range may be set to be 45~180 degrees.

In addition, when the ratio of the front UB mass to the rear UB mass is 1:7 to 3:7 (when the front UB mass is 100 g~300 g, the rear UB mass is 700 g), 4:6 (when the front UB mass is 400 g, the rear UB mass is 600 g), 5:4 to 5:5 (when the front UB mass is 500 g, the rear UB mass is 400 g~500 g), or 6:2 to 6:4 (when the UB mass is 600 g, the rear UB mass is 200 g~400 g), the allowable angle range may be set to be 90~180 degrees.

When the ratio of the front UB mass to the rear UB mass is 4:7 (when the front UB mass is 400 g, the rear UB mass is 700 g), 5:6 (when the front UB mass is 500 g, the rear UB mass is 600 g), 6:1 (when the front UB mass is 600 g, the rear UB mass is 100 g), or 6:5 (when the front UB mass is 600 g, the rear UB mass is 500 g), the allowable angle range may be set to be 135~180 degrees.

The first comparing step S70 may be configured to determine which one of the first allowable mass range and the fourth allowable mass range the measured front and rear UB masses mf and mr fall within. The second comparing step S80 may be configured to determine whether the phase difference is in the allowable angle range. As shown in FIG. 2, when the first comparing step S70 determines that the UB mass mf and the rear UB mass mr are out of the allowable mass range, the control method may implement a braking step S85 for pausing the rotation of the drum. When the rotation of the drum body is paused in the braking step, the control method may sequentially re-start the rotating step S10 and S20, the maintaining step S30, the measuring step S40, the phase difference determining step S50 and the UB mass determining step S60 which are mentioned above.

However, when the first comparing step S70 determines that the front UB mass mf and the rear UB mass mr are in the allowable mass range, the control method may implement the second comparing step S80.

When the second comparing step S80 determines that the phase difference between the UB masses is a value within the allowable angle range, the control method may implement an accelerating step S90 for accelerating the rotation of the drum to a target rotational speed that is larger than the reference rotational speed. However, when it is determined that the phase difference between the two UB masses is over the allowable angle range, the control method may re-start the rotating step S10 and S20, the maintaining step S30, the measuring step S40, the phase difference determining step S50, the UB mass determining step S60 and the first comparing step S70, after the braking step S85.

The laundry treating apparatus according to the present disclosure may determine the size of the UB mass located in each of the upper and rear spaces in the drum body and the phase difference between the two UB masses through the above-noted process. In addition, the front UB mass, the rear UB mass and the phase difference between the two UB masses may be compared with the allowable mass range and the allowable angle range that are measured through the experiments, so as to determine a degree of unbalance in the drum body according to the present disclosure. Then, the acceleration of the drum body may be determined based on the result of the comparison such that the vibration of the tub body may be precisely expected.

Figure 5B:
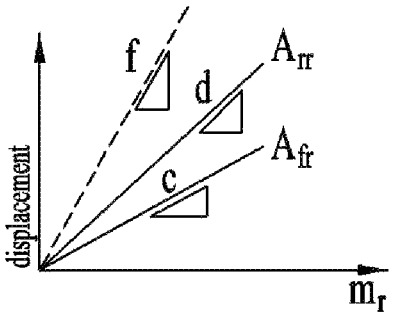
FIG. 5B is a diagram illustrating a rear UB mass mr, a tub front surface displacement Afr and a relation between the rear UB mass and the tub rear surface displacement Arr.

Meanwhile, the relation between the UB masses mf and mr and the tub shown in FIGS. 5A and 5B may not be applied to an area where resonance occurs. In other words, the proportionality between the UB mass and the displacement of the tub may be observable only in the other area except for the resonance area. Accordingly, the control method may be set to be implemented in the other area except for the resonance area in the laundry treating apparatus.

Figure 7:
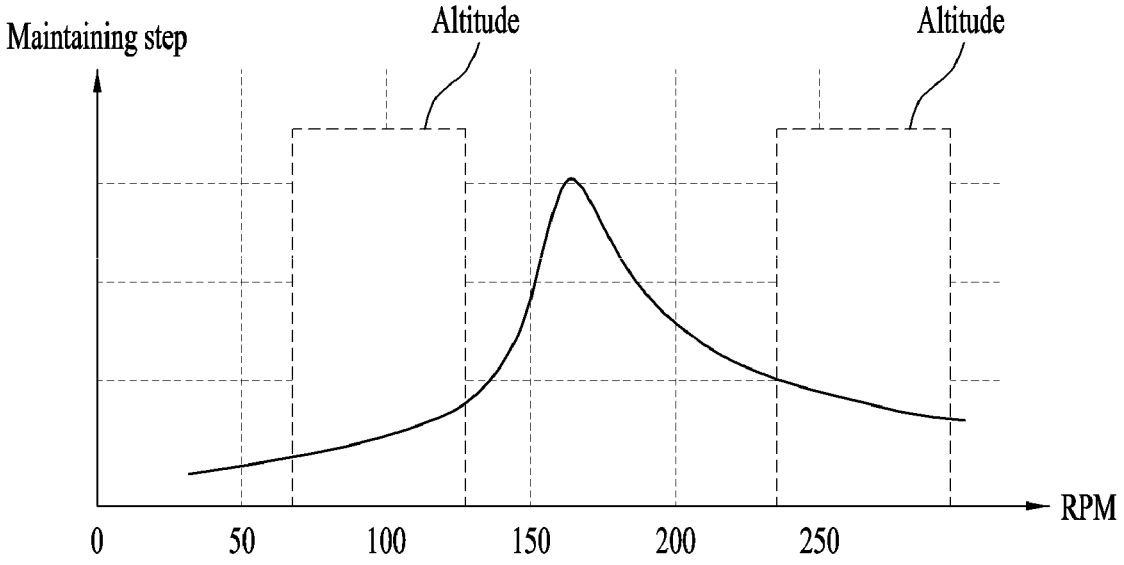
FIG. 7 is a diagram illustrating one example of a time point when the control method for the laundry treating apparatus is implemented.
Figure 8A:
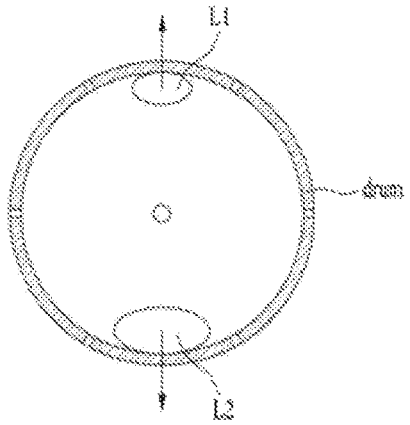
FIG. 8A is a diagram illustrating one example of UB mass.
Figure 8B:
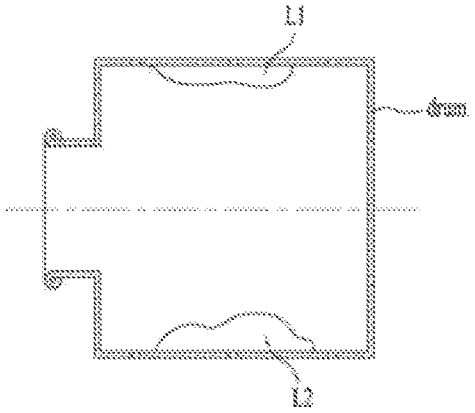
FIG. 8B is a diagram that illustrates an example UB mass that causes dynamic balance.
Figure 8C:
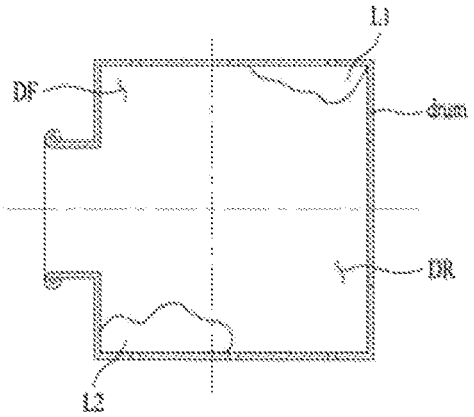
FIG. 8C is a diagram illustrating an example UB mass that causes unbalance.

FIG. 7 illustrates one example of the laundry treating apparatus in which resonance occurs when the drum is rotated approximately at 170 RPM. A reference rotational speed set for the maintaining step S30 has to be lower than 170 RPM or larger than 170 RPM.

According to the experiments, when the reference rotational speed is set to be 25% lower than the minimum rotational speed or 25% higher than the maximum rotational speed (lower than the target rotational speed). Alternatively, the reference rotational speed may be 25% lower than a middle value between the maximum rotational speed and the minimum rotational speed or 25% higher than the middle value.

The tub of the laundry treating apparatus may be vibrated along a longitudinal direction of the cabinet (X-axis direction), a width direction of the cabinet (Y-axis direction) and a height direction of the cabinet (Z-axis direction). The reference rotational speed may be set in consideration of a resonance causing rotational speed at six points. In other words, the reference rotational speed may be determined in consideration of a rotational speed causing resonance in a vertical direction of the tub front surface, a rotational speed causing resonance a horizontal direction of the tub front surface, a rotational speed causing resonance in a back-and-forth direction of the tub front surface, a rotational speed causing resonance in a vertical direction of the tub rear surface, a rotational speed causing resonance in a horizontal direction of the tub rear surface, and a rotational speed causing resonance in a back-and-forth direction of the tub rear surface.

In this instance, the reference rotational speed may be set to be a value of 25% or higher than the lowest one of the six resonance causing rotational speeds. Also, the reference rotational speed may be set to be a value of 25% or higher than the largest one of the six resonance causing rotational speeds and smaller than the target rotational speed.

The sensing unit 7 according to the present disclosure may transmit six data points about the displacement to the controller. In other words, the sensing unit 7 three data about the tub front surface (a vertical displacement, a horizontal displacement and a back-and-forth displacement) to the controller, and three data points about the tub rear surface (a vertical displacement, a horizontal displacement and a back-and-forth displacement) to the controller.

The measuring step S40 may determine that the maximum value of the displacement acting on the front UB mass most sensitively is the maximum displacement of the tub front surface, and that the maximum value of the displacement most sensitively acting on the rear UB mass is the maximum displacement of the tub rear surface.

The displacement that most sensitively acts on the front UB mass may means the displacement that is located in a numerator of a fraction number having the large value gained from dividing the three displacements (the vertical, horizontal and back-and-forth ones) generated in the tub front surface by the three displacements generated in the tub rear surface, when the drum having the laundry loaded only in the drum front area at the reference rotational speed. Similarly, the displacement that most sensitively acts on the rear UB mass may means the displacement that is located in a numerator of a fraction number having the large value gained from dividing the three displacements generated in the tub rear surface by the three displacements generated in the tub rear surface, when the drum having the laundry loaded only in the drum front area at the reference rotational speed.

The displacement of the tub which most sensitively acts on the UB masses may be variable based on the structure of the laundry treating apparatus (the structure of the vibration system). The displacement of the tub that most sensitively acts on the front UB mass may be determined based on the result of the comparison with slopes (a, b, c and d, see FIGS. 5A and 5B) of the displacement function measured through the experiment.

As shown in FIGS. 5A and 5B, it may be assumed that the displacement slope (a) of the tub front surface with respect to the front UB mass is larger than the displacement slope (b) of the tub rear surface and that a displacement slope (d) of the tub rear surface with respect to the rear UB mass is larger than a displacement slope (c) of the tub front surface (e.g., a displacement variation rate of the tub front surface with respect to the size variation of the front UB mass is larger than the displacement variation of the tub rear surface and the displacement variation of the tub rear surface with respect to the size variation of the rear UB mass is larger than the displacement variation of the tub).

In this instance, when the value (a/b) gained by dividing the slope of the tub front surface displacement Aff caused by the front UB mass by the slope of the tub rear surface displacement Arf caused by the front UB mass is large, the front UB mass mf may contribute to the tub front surface displacement more than the tub rear surface displacement.

Accordingly, the slope of the tub front surface displacement measured when the drum is rotated at the same rotational speed while the mass fixed in the front space of the drum (a, the slope of the tub front surface vertical displacement, the slope of the horizontal displacement, and the slope of the back-and-forth displacement) may be divided by the slope of the tub rear surface displacement (b, the slope of the tub rear surface vertical displacement, the slope of the horizontal displacement and the slope of the back-and-forth displacement). The sensing unit 7 may be configured to measure the displacement located in the numerator of the fraction having the largest value of a/b. The measuring step S40 may determine the largest one of the values measured by the sensing unit 7 as the maximum displacement Yf of the tub front surface. Accordingly, the measuring step S40 may measure the maximum displacement Yf of the tub front surface that most sensitively acts on the front UB mass.

Similarly, when a value gained by dividing the slope of the tub rear surface displacement Arr caused by the rear UB mass by the slope of the tub front surface displacement Afr caused by the rear UB mass is large, the rear UB mass mr may contribute to the tub rear surface displacement Arr more than the tub front surface displacement Afr.

Accordingly, when the slope of the tub rear surface displacement measured when the drum is rotated at the same rotational speed while the mass fixed in the rear space of the drum (d) may be divided by the slope of the tub front surface displacement (c). The sensing unit 7 may be configured to measure the displacement located in the numerator of the fraction having the largest value of d/c. The measuring step S40 may determine the largest one of the values measured by the sensing unit 7 as the maximum displacement Yr of the tub rear surface. Accordingly, the measuring step S40 may measure the maximum displacement Yr of the tub rear surface that most sensitively acts on the front UB mass.

It may be assumed based on the experiment that the value (a/b) gained by dividing the vertical displacement of the tub front surface by the back-and-forth displacement of the tub rear surface is the largest and that the value (d/c) gained by dividing the horizontal displacement of the tub rear surface by the back-and-forth displacement of the tub front surface. In this instance, the measuring step S40 may the measuring step S40 may determine the maximum vertical displacement of the tub front surface as the maximum displacement Yf of the tub front surface and the maximum horizontal displacement of the tub rear surface as the maximum displacement Yr of the tub rear surface.

Referring still to FIGS. 5A and 5B, when the slope (a) of the tub front surface displacement with respect to the front UB mass is smaller than the slope (e) of the tub rear surface displacement according to the structure of the laundry treating apparatus, the slope (d) of the tub rear surface displacement with respect to the rear UB mass may be smaller than the slope (f) of the tub front surface displacement.

In this instance, the sensing unit 7 may be configured to measure the displacement located in the numerator of the fraction having the largest value of e/a (the displacement located in the denominator of the fraction having the lowest one vale of a/e). The sensing step S40 may determine the largest one of the values measured by the sensing unit 7 as the maximum displacement Yf of the tub front surface.

Also, the sensing unit 7 may be configured to measure the displacement located in the numerator of the fraction having the largest value of f/d (the displacement located in the denominator of the fraction having the smallest vale of d/f). The sensing step S40 may determine the largest one of the values measured by the sensing unit 7 as the maximum displacement Yf of the tub front surface.

It is determined by the experiment that the displacement most sensitively acting on the front UB mass is likely to be the vertical displacement of the tub front surface and the displacement most sensitively acting on the rear UB mass is likely to be the horizontal displacement of the tub rear surface, when the rotating shaft of the drum is oriented in parallel with the ground, with a relatively large volume of the tub.

It is determined by the experiment that the displacement most sensitively acting on the front UB mass is likely to be the back-and-forth displacement of the tub rear surface and the displacement most sensitively acting on the rear UB mass is likely to be the horizontal displacement of the tub rear surface, when the rotating shaft of the drum is oriented in parallel with the ground, with a relatively large volume of the tub.

When the measuring step S40 (FIG. 2) is configured to determine the maximum displacement of the tub front surface and the maximum displacement of the tub rear surface based on the above-noted method, the displacement having the least effect of the interaction may be measured such that an error between the two measured UB masses and an actual UB mass may be minimized. Also, the vibration of the tub during the rotation of the drum may be expected precisely expected.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A method for controlling a laundry treating apparatus, wherein the laundry treating apparatus comprises:

a tub that defines a space for receiving water, the tub having a tub front surface and a tub rear surface opposite to the tub front surface;

a drum disposed in the tub and having a drum front area and a drum rear area opposite to the drum front area, wherein the drum front area faces the tub front surface and the drum rear area faces the tub rear surface; and a sensing unit configured to sense movement of the tub, the control method comprising:

rotating the drum at a reference rotational speed, the reference rotational speed that is lower or higher than a resonance rotational speed that causes resonance in the laundry treating apparatus;

measuring, using the sensing unit, a front maximum displacement of the tub front surface, a rear maximum displacement of the tub rear surface, and a phase difference between the front maximum displacement and the rear maximum displacement, during the rotation of the drum at the reference rotational speed;

determining a front unbalance mass at the drum front area, a rear unbalance mass at the drum rear area, and an angle between the front unbalance mass and the rear unbalance mass, based on the front maximum displacement of the tub front surface, the rear maximum displacement of the tub rear surface, and the phase difference between the front maximum displacement and the rear maximum displacement; and increasing a drum rotational speed to a target rotational speed that is set to be higher than the reference rotational speed and the resonance rotational speed, based on the front unbalance mass and the rear unbalance mass being in an allowable mass range and further on the angle between the front unbalance mass and the rear unbalance mass being in an allowable angle range.

2. The method according to claim 1, further comprising:

ceasing to rotate the drum based on the front unbalance mass and the rear unbalance mass being out of the allowable mass range.

3. The method according to claim 1, further comprising:

ceasing to rotate the drum based on the angle between the front unbalance mass and the rear unbalance mass being out of the allowable angle range.

4. The method according to claim 1, wherein the allowable mass range is set based on predetermined ranges of the front unbalance mass and the rear unbalance mass in which, when the drum having a mass at the drum front area and the drum rear area is rotated at the target rotational speed, a vibration that is generated in the tub falls in a predetermined allowable vibration range.

5. The method according to claim 4, wherein the allowable angle range is a predetermined angle between the front unbalance mass and the rear unbalance mass in which, when the drum having an unbalance mass within the allowable mass range is rotated at the target rotational speed, the vibration that is generated in the tub falls in the predetermined allowable vibration range.

6. The method according to claim 5, wherein the allowable angle range is between 0 and 180 degrees based on a ratio of the front unbalance mass to the rear unbalance mass being 1:5 or less, 2:5 or less, 3:4 or less, or 5:1 or less.

7. The method according to claim 5, wherein the allowable angle range is between 45 and 180 degrees based on a ratio of the front unbalance mass to the rear unbalance mass being 1:6, 2:6, between 3:5 and 3:6, between 4:3 and 4:5 or between 5:2 and 5:3.

8. The method according to claim 5, wherein the allowable angle range is between 90 and 180 degrees based on a ratio of the front unbalance mass to the rear unbalance mass being between 1:7 and 3:7, 4:6, between 5:4 and 5:5, or between 6:2 and 6:4.

9. The method according to claim 5, wherein the allowable angle range is between 135 and 180 degrees based on a ratio of the front unbalance mass to the rear unbalance mass being 4:7, 5:6, 6:1, or 6:5.

10. The method according to claim 1, wherein the reference rotational speed is lower than the resonance rotational speed by 25% or more.

11. The method according to claim 5, wherein the reference rotational speed is 25% lower than a lowest one of (i) a rotational speed that causes a first-axis resonance of the tub front surface, (ii) a rotational speed that causes a second-axis resonance of the tub front surface, (iii) a rotational speed that causes a third-axis resonance of the tub front surface, (iv) a rotational speed that causes a first-axis resonance of the tub rear surface, (v) a rotational speed that causes a second-axis resonance of the tub rear surface, and (vi) a rotational speed that causes a third-axis resonance of the tub rear surface.

12. The method according to claim 1, wherein the reference rotational speed is higher than the resonance rotational speed by 25% or more, or lower than the target rotational speed.

13. The method according to claim 1, wherein the reference rotational speed is lower than the target rotational speed, or 25% or more higher than a highest one of (i) a rotational speed that causes a first-axis resonance of the tub front surface, (ii) a rotational speed that causes a second-axis resonance of the tub front surface, (iii) a rotational speed that causes a third-axis resonance of the tub front surface, (iv) a rotational speed that causes a first-axis resonance of the tub rear surface, (v) a rotational speed that causes a second-axis resonance of the tub rear surface, and (vi) a rotational speed that causes a third-axis resonance of the tub rear surface.

14. The method according to claim 1, wherein measuring the front maximum displacement, the rear maximum displacement, and the phase difference comprises:

based on displacement variation of the tub front surface being larger than displacement variation of the tub rear surface with respect to size variation of the front unbalance mass, measuring, as the front maximum displacement of the tub front surface, a maximum value in a numerator of a fraction that is a largest value calculated by dividing one of (i) a first-axis displacement variation of the tub front surface with respect to the size variation of the front unbalance mass, (ii) a second-axis displacement variation of the tub front surface with respect to the size variation of the front unbalance mass, and (iii) a third-axis displacement of the tub front surface with respect to the size variation of the front unbalance mass by one of (a) a first-axis displacement of the tub rear surface with respect to the size variation of the front unbalance mass, (b) a second-axis displacement variation of the tub rear surface with respect to the size variation of the front unbalance mass, and (c) a third-axis displacement of the tub rear surface with respect to the size variation of the front unbalance mass.

15. The method according to claim 1, wherein measuring the front maximum displacement, the rear maximum displacement, and the phase difference comprises:

based on displacement variation of the tub front surface being larger than displacement variation of the tub rear surface with respect to size variation of the front unbalance mass, measuring, as the rear maximum displacement of the tub rear surface, a maximum value in a numerator of a fraction that is a largest value calculated by dividing one of (i) a first-axis displacement variation of the tub rear surface with respect to the size variation of the rear unbalance mass, (ii) a second-axis displacement variation of the tub rear surface with respect to the size variation of the rear unbalance mass, and (iii) a third-axis displacement of the tub rear surface with respect to the size variation of the rear unbalance mass by one of (a) a first-axis displacement of the tub front surface with respect to the size variation of the rear unbalance mass, (b) a second-axis displacement variation of the tub front surface with respect to the size variation of the rear unbalance mass, and (c) a third-axis displacement of the tub front surface with respect to the size variation of the rear unbalance mass.

16. The method according to claim 1, wherein measuring the front maximum displacement, the rear maximum displacement, and the phase difference comprises:

based on displacement variation of the tub rear surface being larger than displacement variation of the tub front surface with respect to size variation of the front unbalance mass, measuring, as the front maximum displacement of the tub front surface, a maximum value in a numerator of a fraction that is a largest value calculated by dividing one of (i) a first-axis displacement variation of the tub rear surface with respect to the size variation of the front unbalance mass, (ii) a second-axis displacement variation of the tub rear surface with respect to the size variation of the front unbalance mass, and (iii) a third-axis displacement of the tub rear surface with respect to the size variation of the front unbalance mass by one of (a) a first-axis displacement of the tub front surface with respect to the size variation of the front unbalance mass, (b) a second-axis displacement variation of the tub front surface with respect to the size variation of the front unbalance mass, and (c) a third-axis displacement of the tub front surface with respect to the size variation of the front unbalance mass.

17. The method according to claim 1, wherein measuring the front maximum displacement, the rear maximum displacement, and the phase difference comprises:

based on displacement variation of the tub front surface being larger than displacement variation of the tub rear surface with respect to size variation of the rear unbalance mass, measuring, as the rear maximum displacement of the tub rear surface, a maximum value in a numerator of a fraction that is a largest value calculated by dividing one of (i) a first-axis displacement variation of the tub front surface with respect to the size variation of the rear unbalance mass, (ii) a second-axis displacement variation of the tub front surface with respect to the size variation of the rear unbalance mass, and (iii) a third-axis displacement of the tub front surface with respect to the size variation of the rear unbalance mass by one of (a) a first-axis displacement of the tub rear surface with respect to the size variation of the rear unbalance mass, (b) a second-axis displacement variation of the tub rear surface with respect to the size variation of the rear unbalance mass, and (c) a third-axis displacement of the tub rear surface with respect to the size variation of the rear unbalance mass.

18. The method according to claim 1, wherein measuring the front maximum displacement, the rear maximum displacement, and the phase difference comprises:

determining a maximum first-axis displacement of the tub front surface as the front maximum displacement of the tub front surface; and determining a maximum second-axis displacement of the tub rear surface as the rear maximum displacement of the tub rear surface.

19. The method of claim 1, wherein the tub includes a tub opening defined at the tub front surface.

20. The method of claim 1, wherein the sensing unit is configured to detect three-axis acceleration and three-axis angular velocity.

* * * * *